US007793456B1

(12) United States Patent
Lacorte

(10) Patent No.: US 7,793,456 B1
(45) Date of Patent: Sep. 14, 2010

(54) GUN SIGHT RETICLE HAVING ADJUSTABLE SIGHTING MARKS FOR BULLET DROP COMPENSATION

(75) Inventor: Jon B. Lacorte, East Northport, NY (US)

(73) Assignee: Nikon Inc., Melville, NY (US)

( * ) Notice: Subject to any disclaimer, the term of this patent is extended or adjusted under 35 U.S.C. 154(b) by 349 days.

(21) Appl. No.: 11/979,213

(22) Filed: Oct. 31, 2007

(51) Int. Cl.
*F41G 1/38* (2006.01)

(52) U.S. Cl. ..... 42/122

(58) Field of Classification Search ..... 42/122, 42/123, 125, 126, 130, 131
See application file for complete search history.

(56) References Cited

U.S. PATENT DOCUMENTS

| | | | | | |
|---|---|---|---|---|---|
| 476,874 | A | * | 6/1892 | Cummings | 42/122 |
| 2,028,055 | A | * | 1/1936 | Forsling | 42/130 |
| 2,094,623 | A | * | 10/1937 | Stokey | 356/247 |
| 2,162,723 | A | * | 6/1939 | Karnes | 42/123 |
| 2,189,766 | A | * | 2/1940 | Unertl | 33/298 |
| 2,336,107 | A | * | 12/1943 | Litschert | 42/126 |
| 2,425,713 | A | * | 8/1947 | Applegate | 356/12 |
| 2,500,405 | A | * | 3/1950 | Fairbank | 33/297 |
| 3,392,450 | A | | 7/1968 | Herter et al. | |
| 4,403,421 | A | * | 9/1983 | Shepherd | 42/122 |
| 4,584,776 | A | | 4/1986 | Shepherd | |
| D285,540 | S | | 9/1986 | Allen | |
| 4,618,221 | A | * | 10/1986 | Thomas | 359/428 |
| 4,789,231 | A | | 12/1988 | Shimizu | |
| D306,173 | S | | 2/1990 | Reese | |
| 5,025,565 | A | * | 6/1991 | Stenerson et al. | 33/265 |
| 5,464,003 | A | * | 11/1995 | Sherman | 124/87 |
| 5,491,546 | A | | 2/1996 | Wascher et al. | |
| 5,511,318 | A | * | 4/1996 | Logan | 33/298 |
| D397,704 | S | | 9/1998 | Reese | |
| D403,686 | S | | 1/1999 | Reese | |
| 5,920,995 | A | | 7/1999 | Sammut | |
| 6,032,374 | A | | 3/2000 | Sammut | |
| 6,357,158 | B1 | | 3/2002 | Smith, III | |
| D456,057 | S | | 4/2002 | Smith, III | |
| 6,539,637 | B1 | * | 4/2003 | Hollabaugh | 33/265 |
| D475,758 | S | | 6/2003 | Ishikawa | |
| 6,591,537 | B2 | | 7/2003 | Smith | |
| D530,775 | S | | 10/2006 | LaCorte | |
| D530,776 | S | | 10/2006 | LaCorte | |
| 7,171,775 | B1 | * | 2/2007 | Lacorte | 42/122 |
| 2002/0124452 | A1 | * | 9/2002 | Sammut | 42/122 |
| 2003/0086165 | A1 | * | 5/2003 | Cross et al. | 359/424 |
| 2005/0005495 | A1 | | 1/2005 | Smith | |

OTHER PUBLICATIONS

T.D. Smith, III; "Beware the One-Gun Man!"; T.D. Smith, Inc.; pp. 55-62, 65 and 2 pp. drawings figures 1-4; 1992.

* cited by examiner

*Primary Examiner*—Troy Chambers
*Assistant Examiner*—Reginald Tillman, Jr.
(74) *Attorney, Agent, or Firm*—Oliff & Berridge, PLC

(57) ABSTRACT

A gun sight reticle includes a plurality of adjustable sighting marks disposed vertically below the central sighting mark. The shooter can adjust the BDC sighting marks so that they more accurately correspond to the correct aiming position for targets that are disposed at various distances from the shooter.

21 Claims, 7 Drawing Sheets

GUN SIGHT RETICLE HAVING ADJUSTABLE SIGHTING MARKS FOR BULLET DROP COMPENSATION

BACKGROUND

The invention relates to gun sight reticles, and in particular to gun sight reticles that provide for bullet drop compensation.

It is common to use a gun sight, in particular, a telescopic gun sight (also called a "scope"), for longer-range guns such as rifles and for shorter-range guns such as muzzle-loaders and shotguns. With either type of gun, the projectile follows a generally parabolic trajectory. The particular trajectory depends upon both the gun and the projectile. An experienced shooter knows that one must consider the projectile trajectory and distance to target when aiming at the target. Depending upon the distance to the target, one might need to aim over the target so that the projectile strikes the target where intended.

In order to assist shooters, it is known to provide gun sights having aiming points (also called "sighting marks") in addition to the central aiming point formed by a center horizontal hairline and a center vertical hairline that forms an aiming point at the center of a reticle. These conventional reticles, known as bullet drop compensation reticles, typically have a plurality of aiming points formed by a plurality of intersecting hairlines located at predetermined distances below the central aiming point. These bullet drop compensation reticles provide additional horizontal hairlines at specified distances below the center horizontal hairline so as to form the additional aiming points where those additional horizontal hairlines intersect the center vertical hairline. See, for example, U.S. Pat. No. 5,920,995 and U.S. Pat. No. 6,591,537. The disclosures of U.S. Pat. No. 5,920,995 and U.S. Pat. No. 6,591,537 are hereby incorporated herein by reference in their entireties.

U.S. Pat. No. 7,171,775, entitled "Gun Sight Reticle Having Open Sighting Areas for Bullet Drop Compensation" discloses a reticle in which the bullet drop compensation aiming points are defined by open areas, for example, circular areas circumscribed by indicia. The open sighting areas are advantageous because there is no indicia (markings) at the aiming point, and thus the shooter has a better view of the target. The open sighting areas are disposed at fixed positions below the central aiming point as are the crosshair-type bullet drop compensation aiming points of the two patents identified above. The disclosure of U.S. Pat. No. 7,171,775 is incorporated herein by reference in its entirety.

Prior to using a gun having a scope fitted with a bullet drop compensation reticle, the shooter typically adjusts the scope. In particular, the scope includes adjustment mechanisms for adjusting the vertical and horizontal position of the scope, and those mechanisms are adjusted so that a projectile fired by the gun will strike a target at a known distance (for example, 100 yards or 200 yards) when the central aiming point of the reticle is aligned with that target. This process can be considered to be a "calibration" process. The bullet drop compensation aiming points are disposed at fixed positions vertically below the central aiming point. For example, a first bullet drop compensation (BDC) aiming point is located a first predetermined distance directly below the central aiming point, a second BDC aiming point is located a second predetermined distance (greater than the first predetermined distance) below the central aiming point such that the second BDC aiming point is directly below the first BDC aiming point, etc. Thus, after the scope is calibrated, the shooter can position the first BDC aiming point on a target that is a first distance (for example, 300 yards) from the shooter, position the second BDC aiming point over a target that is a second, greater distance (for example, 400 yards) from the shooter, etc.

SUMMARY

However, because the flight of a projectile is affected by many factors, the BDC aiming points having fixed positions below the central aiming point can only approximate the correct aiming point for a target at a given distance, even after the scope is calibrated using the central aiming point. For example, each gun and each type of projectile has its own projectile-flight characteristics. In addition, environmental factors such as altitude, temperature and humidity affect the trajectory of a bullet. Accordingly, a skilled shooter will typically learn through experience with his gun where the correct aiming points exist for targets located at various distances from the shooter.

According to aspects of the invention, a gun sight reticle includes a plurality of adjustable sighting marks disposed vertically below the central sighting mark. The shooter can adjust the position of the BDC sighting marks so that they more accurately correspond to the correct aiming position for targets that are disposed at various distances from the shooter.

According to preferred embodiments, the adjustable sighting marks are movable sighting marks arranged in a substantially straight vertical line disposed directly below the central sighting mark, and the sighting marks are individually movable. For example, the scope having the gun sight reticle can include a turret having an adjustment mechanism for each of the BDC sighting marks such that the shooter can adjust the vertical position of the BDC sighting marks by moving the sighting marks using the corresponding adjustment mechanisms.

According to preferred embodiments, each of the movable sighting marks includes a corresponding horizontal windage-compensation line that extends from opposite sides of the movable sighting mark and that moves with the movable sighting mark. Preferably, each of the windage-compensation lines has spaced-apart rulings along its length.

According to some embodiments, the movable sighting marks include indicia that circumscribes a corresponding sighting area. For example, the indicia can be in the shape of a circle so that the shooter can view the target without any indicia (such as hairlines) obstructing the shooter's view of the target. According to a preferred embodiment, the indicia is in the shape of a circle.

The adjustable sighting marks can be defined by various structure. According to one embodiment, each of the adjustable sighting marks is a movable sighting mark that includes a movable member having a sighting-mark-defining portion. According to another embodiment, the adjustable sighting marks include a plurality of light-emitting elements, and the user adjusts the device by selecting which of the light-emitting elements is to be activated for a particular distance-to-target and/or bullet type.

Typically, the gun sight reticle is part of a telescopic gun sight having a housing, an objective lens disposed near a first end of the housing and an ocular lens disposed near a second end of the housing. The gun sight reticle is located within the housing between the objective lens and the ocular lens.

BRIEF DESCRIPTION OF THE DRAWINGS

The invention will be described in conjunction with the following drawings of exemplary embodiments in which like reference numerals designate like elements, and in which.

DETAILED DESCRIPTION OF EXEMPLARY EMBODIMENTS

Figure 1:
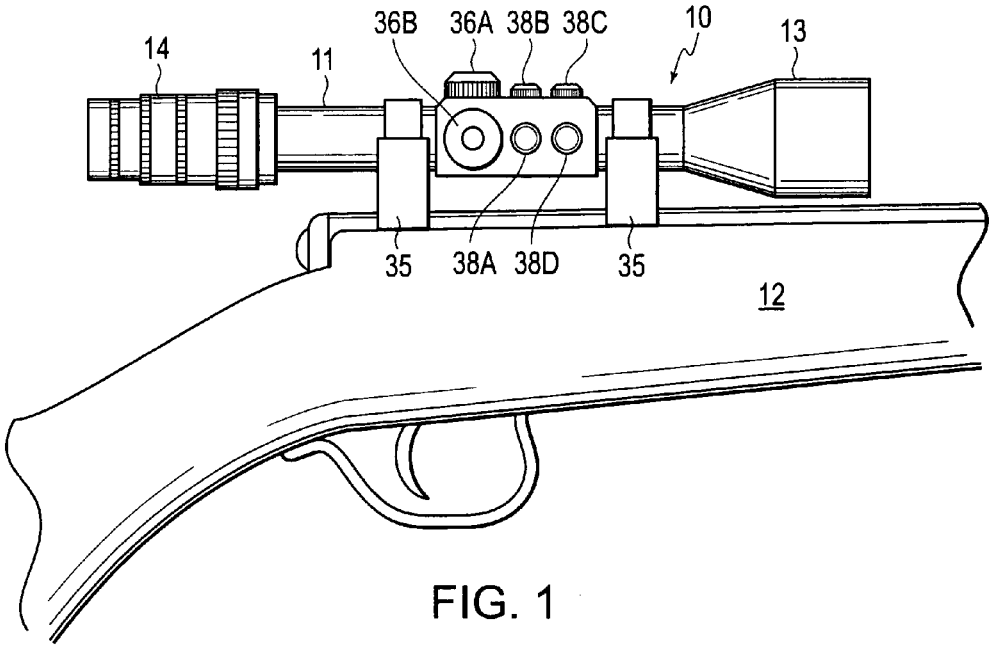
FIG. 1 is a side view of a telescopic sight to which embodiments of the invention may be applied.
Figure 2:
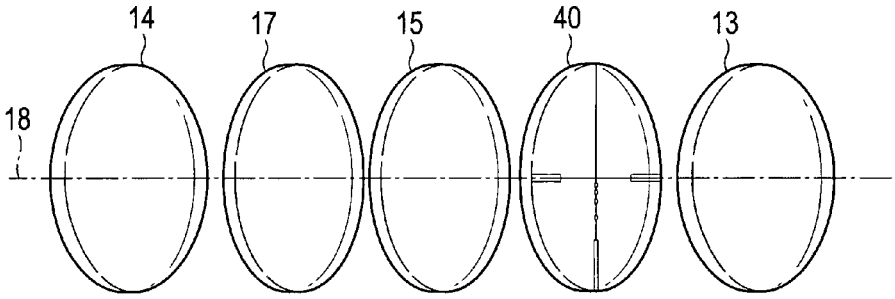
FIG. 2 is a schematic illustration of internal components of a variable power telescopic sight shown in FIG. 1.

As shown in FIGS. 1 and 2, a telescopic gun sight 10 to which the invention may be applied is shown attached by a suitable mount 35 to a rifle 12. The gun sight 10 is formed by a tubular housing 11 containing a forwardly positioned objective lens element 13, a rearwardly positioned ocular or eyepiece lens element 14, an intervening erector lens element 15, and a reticle 40 disposed between the objective lens element 13 and the erector lens element 15. In the case of a vari-focal or zoom scope, a positionally adjustable magnifying lens 17 is associated with the erector lens element 15. The exterior of the housing 11 may be equipped with rotationally movable features (for example, rotatable knobs) for adjusting focus, magnification ratio, windage and elevation. In the illustrated embodiment, a first knob 36A is used to adjust the left-to-right, or horizontal, position of the scope 10, a second knob 36B is used to adjust the up-down, or vertical, position of the scope 10, and a third set of adjustment features 38A-38D, to be described in more detail below, is used to adjust the vertical position of each BDC sighting mark. The various lens elements may be single lenses or lens groups.

The reticle 40 is a circular planar or flat transparent panel or disk mounted within the housing 11 in perpendicular relationship to the optical axis or line of sight 18 of the scope 10. The reticle 40 is positioned between the objective lens element 13 and the erector lens element 15 at a location considered to be a front focal plane of the optical system within the housing. The reticle 40 contains fine lines or hairline indicia to be described below.

Figure 3:
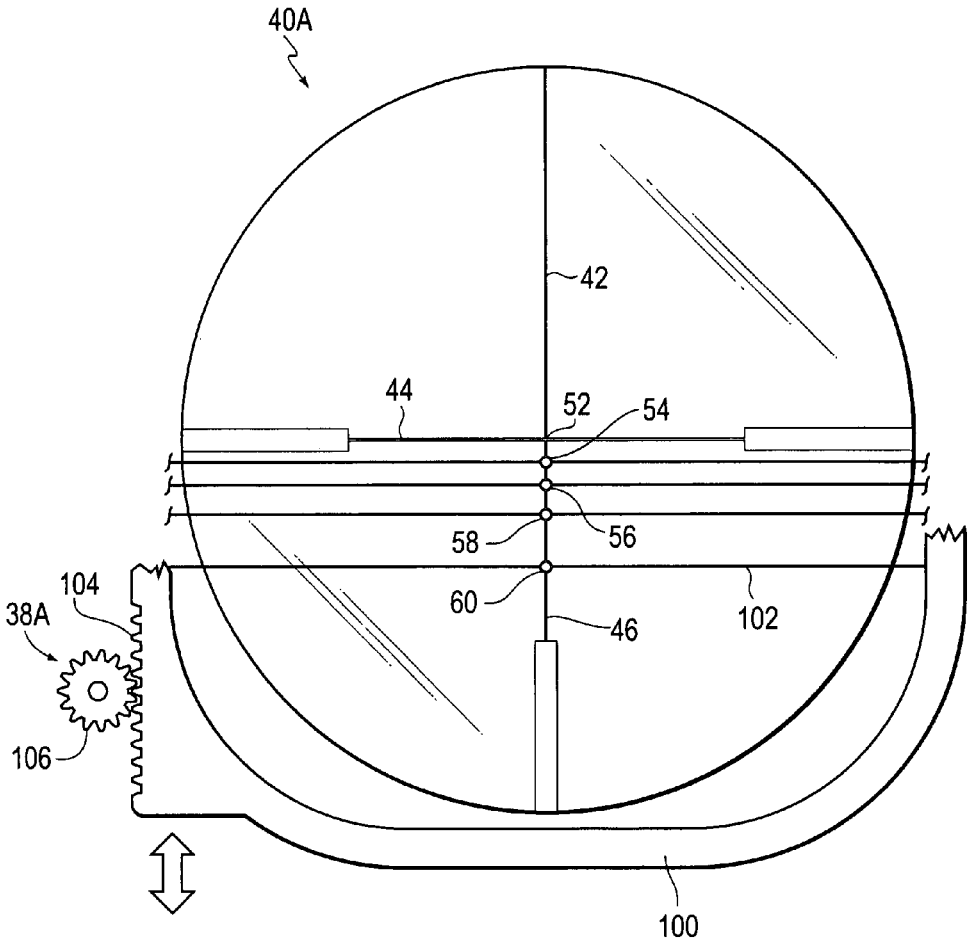
FIG. 3 is a plan view of a gun sight reticle having movable BDC sighting marks according to one embodiment of the invention.

As shown in FIG. 3, one reticle 40*a* to which the invention may be applied includes a center horizontal straight hairline 44 and a center vertical straight hairline 42 that orthogonally intersect each other at the central aiming point 52. A portion 46 of the center vertical hairline 42 disposed below the center horizontal hairline 44 includes a plurality of BDC sighting marks 54, 56, 58 and 60. First sighting mark 54 is located below and closest to the central aiming point 52. Second sighting mark 56 is located below the first sighting mark 54. Third sighting mark 58 is located below the second sighting mark 56. Fourth sighting mark 60 is located below the third sighting mark 58. Each of the BDC sighting marks 54-60 is movable in the vertical direction, to be described below.

As mentioned earlier, a user typically calibrates the central aiming point 52 so that when the central aiming point 52 is placed over a target at a known distance, the bullet will strike the target. For example, by firing a series of shots while making compensatory adjustments of the scope 10 by adjusting the knobs 36A and 36B, the shooting system (the gun, particular type of bullet and gun sight) are "zeroed-in" so that the position on the target of the crossed hairlines 42 and 44 (that is, the central aiming point 52) coincides with the point of bullet impact. For a longer-range gun such as a high-powered rifle, the gun may be zeroed-in at 200 yards such that a bullet fired by the rifle will strike the target when the central aiming point 52 of the reticle is placed over the target during aiming. For a shorter-range gun such as a muzzleloader or a shotgun, the zeroed-in range may be 100 yards.

Unlike known reticles, the BDC reticle according to aspects of the invention permits the BDC sighting marks 54-60 to be adjusted relative to the central aiming point 52 to compensate for factors such as the particular gun, the particular type of bullet, and environmental conditions such as temperature, humidity and altitude. By providing adjustable BDC sighting marks 54-60, which are movable in the vertical direction (for example, along the lower portion 46 of the center vertical hairline 42), the BDC sighting marks also can be "zeroed-in" in a manner similar to what was described above with respect to the central aiming point 52. Of course, when zeroing-in each of the BDC sighting marks 54-60, the target will be located progressively farther from the reticle. For example, if the central aiming point 52 was zeroed-in at 200 yards, the first sighting mark 54 could be zeroed-in for a target located at 300 yards, the second sighting mark 56 could be zeroed-in for a target located at 400 yards, the third sighting mark 58 could be zeroed-in for a target located at 500 yards, and the fourth sighting mark 60 could be zeroed-in for a target at 600 yards.

Figure 6:
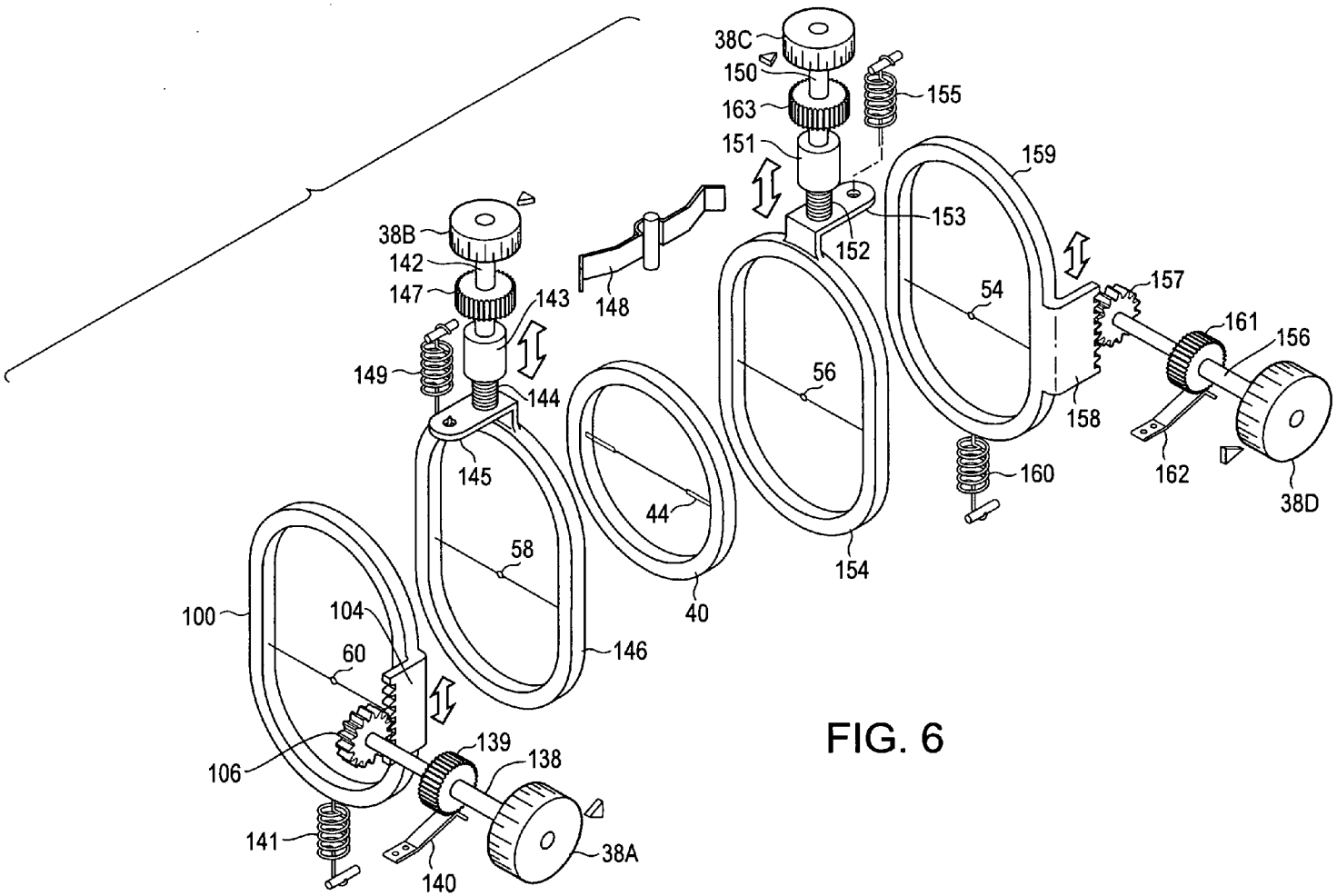
FIG. 6 is an exploded perspective view of the sighting mark adjustment mechanism according to one embodiment.

Various arrangements of the BDC sighting marks are possible that can be adjusted in the vertical direction. FIG. 6 shows a first embodiment of the invention.

Turning the knob 38A in FIG. 6 moves the fourth sighting mark 60 in FIG. 3. In particular, turning the knob 38A causes the pinion 106 to turn via shaft 138 attached to knob 38A. The pinion 106 is engaged with the tooth 104 on the movable member 100 and moves member 100 in the up-and-down direction. Thus, the sighting mark 60 can be set at any vertical position. The set position is maintained by the teeth 139 on shaft 138 engaging a leaf spring 140. Member 100 also is attached to a spring 141 that is biased downward in FIG. 6. This eliminates any slack between the small gear 106 and the teeth 104. This also stabilizes the position of the sighting mark 60 even after receiving an impact due to firing of the gun.

Movement of third sighting mark 58 now is explained. The knob 38B turns the shaft 142 which rotates the female screw 143. Rotating female screw 143 moves the male screw 144, which is engaged with the female screw 143, in the up-and-down direction. The male screw 144 is fixed to an arm 145 of movable member 146 and makes the movable member 146 move in the up-and-down direction. Thus, the sighting mark 58 can be set at any desired vertical position. The set position is maintained by the teeth 147 on shaft 142 engaging a leaf spring 148. Arm 145 also is attached to a spring 149 that is biased upward in FIG. 6. This eliminates any slack between the female screw 143 and the male screw 144. This also stabilizes the position of the sighting mark 58 even after receiving an impact due to firing of the gun.

In order to move the sighting mark 56, knob 38C is turned, which turns shaft 150 and rotates female screw 151. Rotating female screw 151 moves the male screw 152, which is engaged with the female screw 151, in the up-and-down direction. The male screw 152 is fixed to an arm 153 of movable member 154 and makes the movable member 154 move in the up-and-down direction. Thus, the sighting mark 56 can be set at any desired vertical position. The set position is maintained by the teeth 163 on shaft 150 engaging the leaf spring 148. Arm 153 also is attached to a spring 155 that is biased upward in FIG. 6. This eliminates any slack between the female screw 151 and the male screw 152. This also stabilizes the position of the sighting mark 56 even after receiving an impact due to firing of the gun.

In order to move the first sighting mark 54, knob 38D is turned, which turns shaft 156 and pinion 157. The pinion 157 is engaged with the teeth 158 on a movable member 159 and moves the member 159 in the up-and-down direction. Thus, the sighting mark 54 can be set at any desired vertical position. The set position is maintained by the teeth 161 on shaft 156 engaging a leaf spring 162. Member 159 also is attached to a spring 160 that is biased downward in FIG. 6. This eliminates any slack between the small gear 157 and the teeth 159. This also stabilizes the position of the sighting mark 54 even after receiving an impact due to firing of the gun.

The reticle 40 in the center of FIG. 6 is fixed and not movable. In this embodiment, reticle 40 is positioned at the first focal plane, but it is possible to position reticle 40 at the second focal plane, that is, behind the lenses 15 and 17 in front of the lens 14 in FIG. 2

Figure 4:
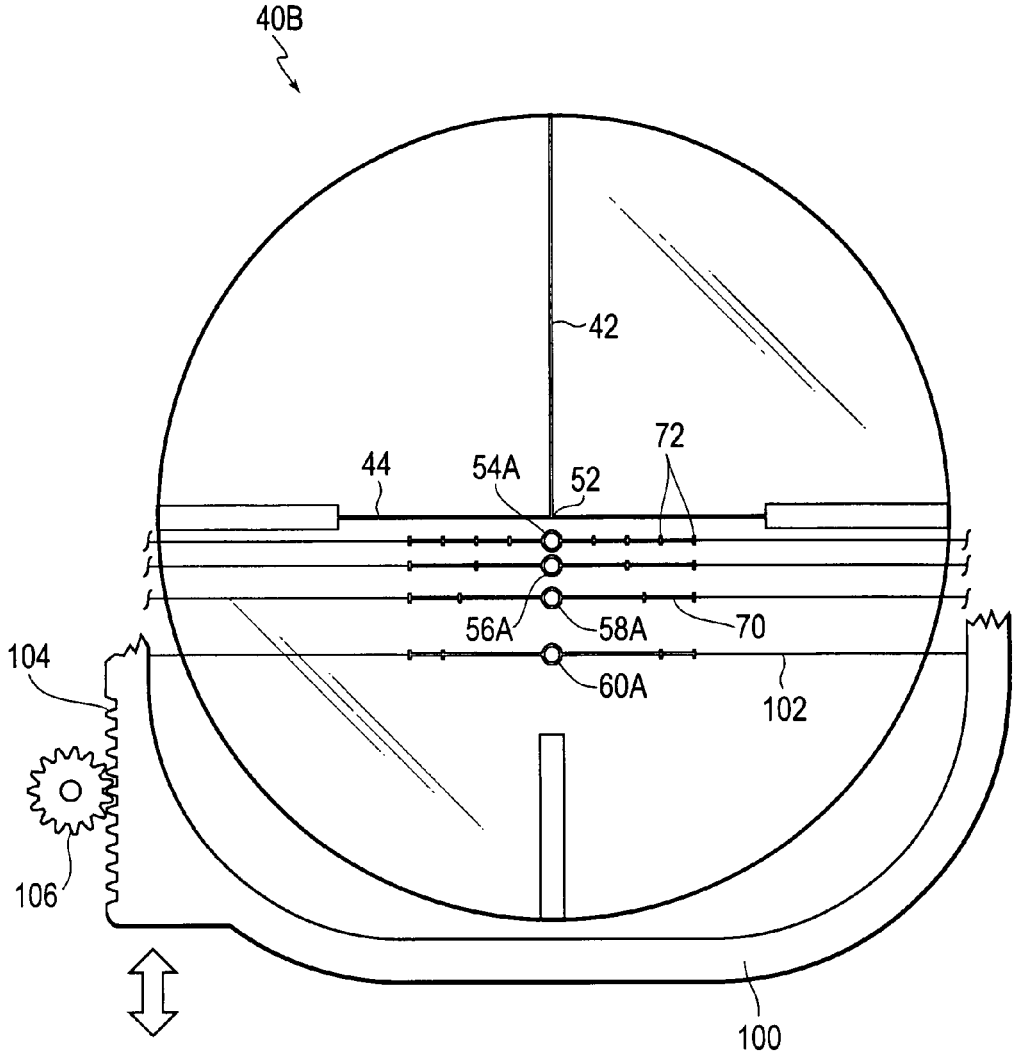
FIG. 4 is a plan view of a gun sight reticle having movable sighting marks according to a second embodiment of the invention.
Figure 5:
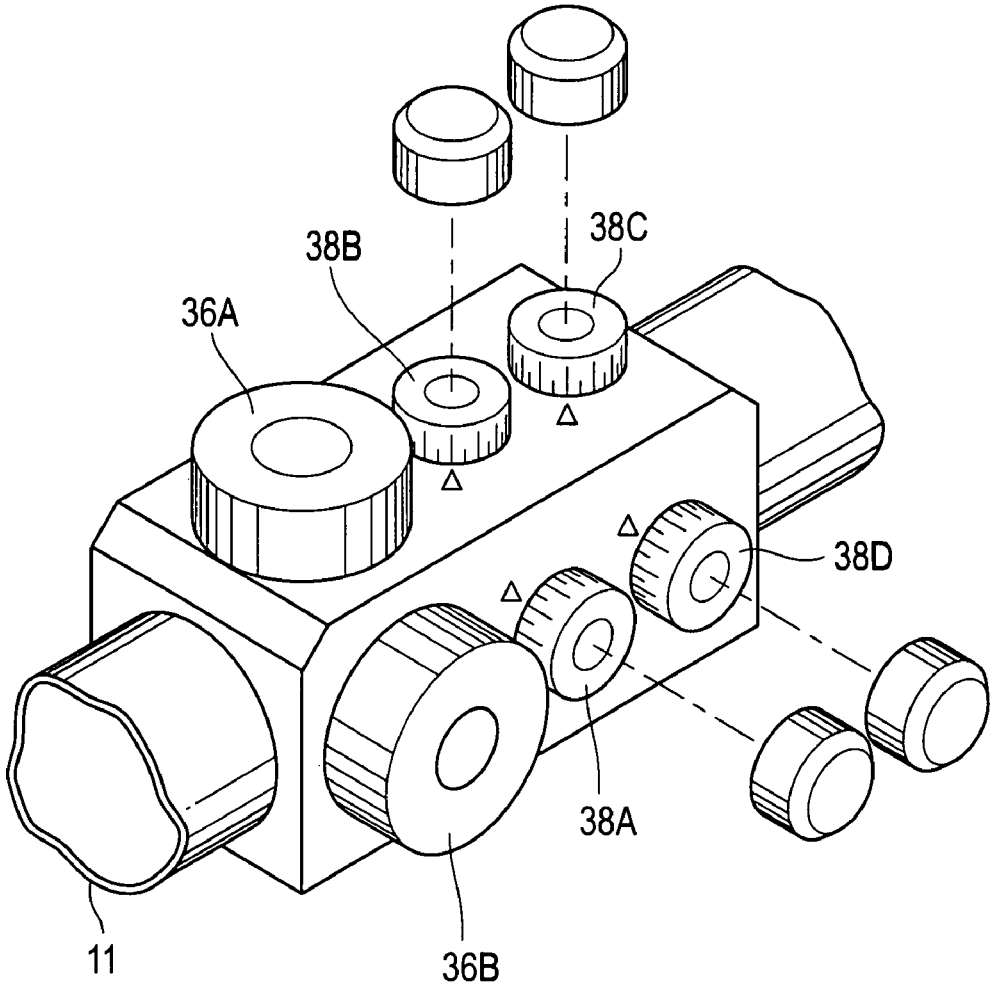
FIG. 5 is a detailed perspective view of the adjustment feature-containing portion of the telescopic sight shown in FIG. 1.

FIG. 4 shows another embodiment of a reticle 40*b* to which the invention is applied. In the embodiment of FIG. 4, each BDC sighting mark is an open sighting area (instead of a solid mark), and each BDC sighting mark also includes a windage line 70 having rulings 72. In particular, each of the sighting marks is an open sighting area circumscribed by indicia in the shape of a circle. Accordingly, open sighting areas 54*a*, 56*a*, 58*a* and 60*a* are provided. Unlike the embodiment of FIG. 3, the center vertical hairline 42 does not include a portion disposed below the center horizontal hairline 44. The structure for vertically adjusting the positions of the open sighting areas 54*a*-60*a* is the same as described with respect to FIG. 3.

An electronic embodiment now will be described. This embodiment uses electronically implemented sighting marks instead of physically movable sighting marks for use in bullet drop compensation. In this embodiment, one out of a plurality of bullet drop compensation sighting marks can be activated based on distance to the target and one or more other factors such as the bullet type, and/or environmental factors such as altitude, temperature and humidity.

Figure 9:
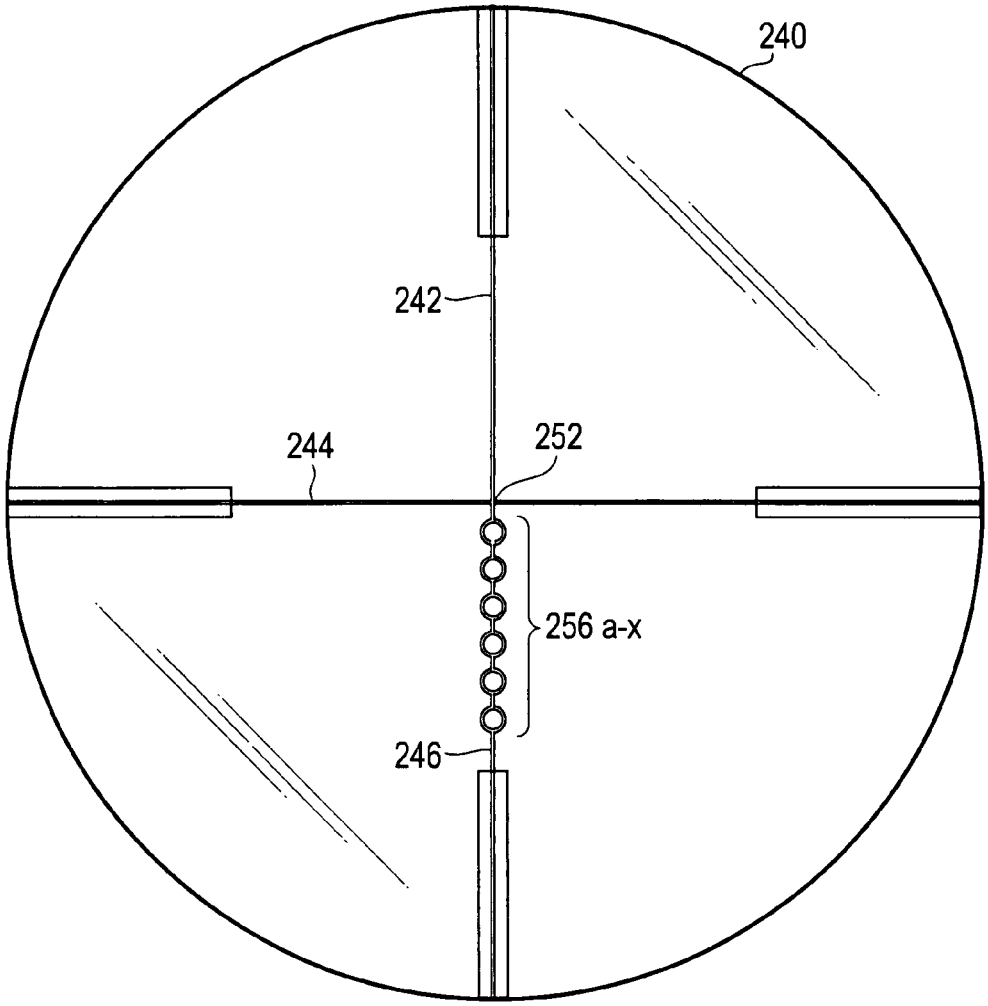
FIG. 9 shows a reticle of the FIG. 7 embodiment.

FIG. 9 shows a reticle 240 implementing this embodiment. The reticle 240 includes a center horizontal straight hairline 244 similar to previously described hairline 44 and a center vertical straight hairline 242 similar to previously described hairline 42. Hairlines 242 and 244 intersect at central aiming point 252. On the lower portion 246 of center vertical straight hairline 242 are provided a plurality of bullet drop compensation sighting marks 256*a-x*. While FIG. 9 shows five bullet drop compensation sighting marks, more than five selectable sighting marks typically would be provided. The higher number of marks that are provided, the more adjustability is provided in the bullet drop compensation sighting marks.

Figure 7:
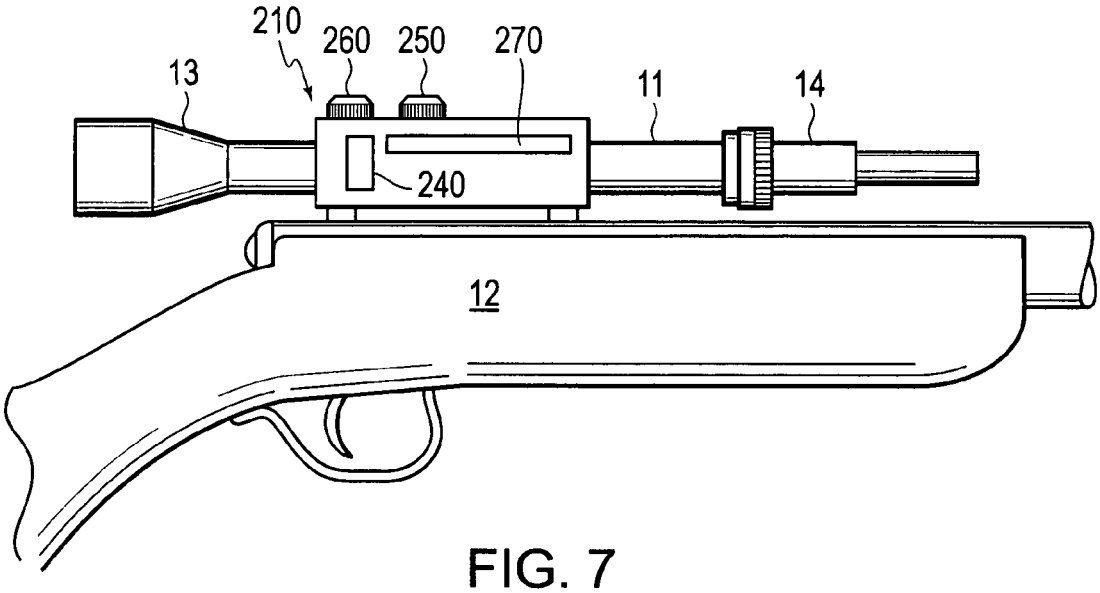
FIG. 7 is a side view of a telescopic sight according to an electronically-implemented embodiment.
Figure 8:
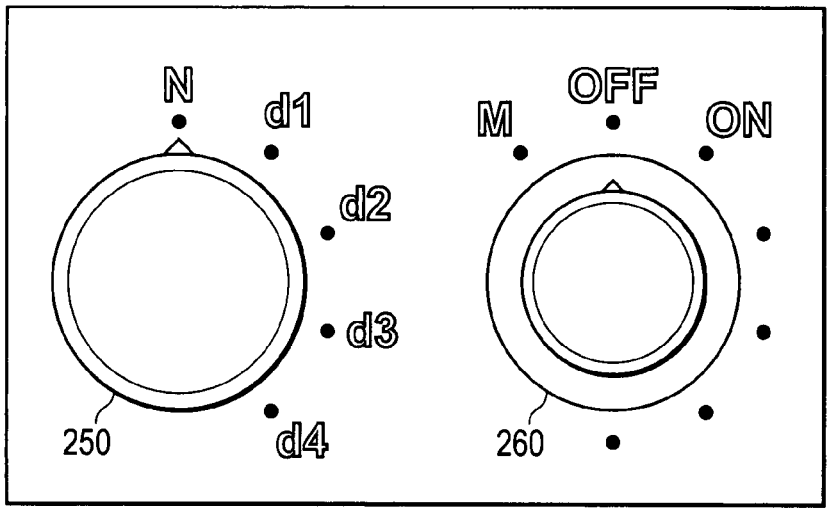
FIG. 8 is a top view of the FIG. 7 sight showing the control dials.

In the electronic embodiment associated with FIGS. 7-9, one or more of the plurality of sighting marks 256*a-x* can be selectively activated so as to function as a sighting mark for a particular distance. For example, using a calibration procedure similar to what was described above for the mechanical embodiment, a user could determine which of the sighting marks 256*a-x* is appropriate for a particular distance and bullet type under current atmospheric conditions, for example, and then select that mark for future use with that bullet. Using the calibration procedure, the user could select a plurality of different ones of the marks 256*a-x* for a particular bullet and at different distances (for example, 100 yards, 200 yards, 300 yards, 400 yards) and store those selected marks in memory. Then, when using the scope, the user could activate the scope such that the preselected marks are activated (for example, lighted) for that bullet type. The user could preselect different marks for different types of bullets such that by inputting a bullet type, the preselected set of marks out of marks 256*a-x* is activated for the selected bullet type. Alternatively, only one of the sighting marks 256*a-x* could be activated by user input of the bullet type and the distance-to-target. The input of the distance-to-target could be made by the user selecting the distance or by a rangefinder also included in the scope, wherein the rangefinder automatically inputs the determined distance to a particular target.

The plurality of sighting marks 256*a-x* could be provided by any number of different structures. According to one example, a plurality of holes are provided in the metal layer forming the lower portion 246 of the center vertical straight hairline 242, and an end of an optical fiber can be disposed in each of those holes (one optical fiber being provided for each hole, the holes being disposed in a vertical line). The sighting mark defined by the hole is activated (illuminated) by supplying light to the input end of the optical fiber associated with that hole. One advantage of this structure is that the optical fibers (except for their output end portions) can be hidden behind the opaque portions of the hairline 246 where the holes are not located. In addition, the holes in the hairline enable the user to view the target without any obstruction (providing sighting areas like the embodiment of FIG. 4). The output ends of the optical fibers do not obstruct the user's view because they are transparent.

According to another embodiment, a vertically-arranged series of LEDs or electroluminescent elements, for example, can be provided to form the bullet drop compensation sighting marks 256*a-x*. Other implementations also are possible.

An embodiment in which one bullet drop compensation sighting mark is illuminated at any particular moment now will be described in conjunction with FIGS. 7-9. FIG. 7 shows a rifle 12 to which a telescopic gun sight 210 having electronic bullet drop compensation sighting marks as shown in FIG. 9 is attached. The scope includes an internal control circuit 270 that receives inputs, to be described below, and that controls which of the plurality of bullet drop compensation sighting marks 256*a-x* is/are to be activated. Control knobs 250 and 260, to be described below, are provided on the top surface of the scope 210.

When the dial 250 is placed in position N and/or when dial 260 is in the OFF position, none of the sighting marks 256*a-x* is lighted. The dials 250 and 260 can incorporate an encorder or a resistive element outputting a variable signal to the control circuit 270 based upon the position of the dials.

According to one embodiment, different sets of sighting marks are stored in advance for each bullet type. That is, for each type of bullet, a set of sighting marks (selected out of available sighting marks 256*a-x*) is set for different distances (for example, 100 yards, 200 yards, 300 yards, 400 yards). The user selects the bullet type by using dial 250 to select either d1, d2, d3 or d4, and the user selects the distance to target using dial 260 (dial 260 also would include indicia identifying each selectable distance-to-target for each of the marks, which are not labeled in FIG. 8). Accordingly, based upon data previously stored in memory (such data could be stored in the factory or input by the user based on a calibration process described above), the appropriate sighting mark out of the plurality of sighting marks 256*a-x* for the particular bullet type and distance-to-target will be illuminated. This embodiment enables different sighting marks to be illuminated for different bullet types even if the distance-to-target is the same. Accordingly, the embodiment enables more accurate aiming than existing systems that provide a single bullet drop compensation mark for a particular distance-to-target.

While the invention has been described with reference to preferred embodiments thereof, it is to be understood that the invention is not limited to these embodiments or constructions. The invention is intended to cover various modifications and arrangements. While the various elements of the exemplary embodiments are shown in various combinations and configurations, other combinations and configurations, including more, less or only a single element, also are within the spirit and scope of the invention.

What is claimed is:

1. A gun sight reticle comprising:

a center horizontal straight hairline;

a central sighting mark disposed substantially at a center of the center horizontal straight hairline; and a plurality of adjustable sighting marks disposed in a substantially straight vertical line below the center horizontal hairline, the adjustable sighting marks being adjustable relative to the center horizontal straight hairline.

2. The gun sight reticle of claim 1, wherein the plurality of adjustable sighting marks are movable relative to the central sighting mark.

3. The gun sight reticle of claim 1, wherein the plurality of movable sighting marks are individually adjustable relative to the center horizontal straight hairline.

4. The gun sight reticle of claim 1, wherein the plurality of movable sighting marks are disposed directly below the central sighting mark.

5. The gun sight reticle of claim 2, wherein the plurality of movable sighting marks are individually movable.

6. The gun sight reticle of claim 2, wherein each of the movable sighting marks includes a corresponding horizontal windage-compensation line that extends from opposite sides of the movable sighting mark and that moves with the movable sighting mark.

7. The gun sight reticle of claim 6, wherein each of the windage-compensation lines has spaced-apart rulings along its length.

8. The gun sight reticle of claim 2, wherein each of the movable sighting marks includes indicia that circumscribes a corresponding sighting area.

9. The gun sight reticle of claim 2, wherein each of the movable sighting marks includes a movable member having a sighting-mark-defining portion.

10. The gun sight reticle of claim 2, wherein the plurality of movable sighting marks are movable in a vertical direction relative to the central sighting mark.

11. The gun sight reticle of claim 5, wherein the plurality of movable sighting marks are movable in a vertical direction relative to the central sighting mark.

12. The gun sight reticle of claim 7, wherein the plurality of movable sighting marks are movable in a vertical direction relative to the central sighting mark.

13. The gun sight reticle of claim 9, wherein the plurality of movable sighting marks are movable in a vertical direction relative to the central sighting mark.

14. The gun sight reticle of claim 1, wherein the plurality of adjustable sighting marks are a plurality of individually selectable light emitters.

15. The gun sight reticle of claim 14, further comprising a circuit that selects one of the plurality of light emitters based on distance-to-target, the circuit permitting the light emitter that is to be selected for a particular distance-to-target to be varied.

16. The gun sight reticle of claim 15, wherein the circuit selects one of the plurality of light emitters based on distance-to-target and bullet type.

17. The gun sight reticle of claim 14, further comprising a circuit that selects at least one of the plurality of light emitters based on bullet type.

18. A telescopic gun sight comprising:

a housing;

an objective lens disposed near a first end of the housing;

an ocular lens disposed near a second end of the housing; and the gun sight reticle of claim 1 located within the housing between the objective lens and the ocular lens.

19. A telescopic gun sight comprising:

a housing;

an objective lens disposed near a first end of the housing;

an ocular lens disposed near a second end of the housing; and a gun sight reticle located within the housing between the objective lens and the ocular lens, the gun sight reticle comprising:

a center horizontal straight hairline;

a central sighting mark disposed substantially at a center of the center horizontal straight hairline;

a plurality of adjustable sighting marks disposed in a substantially straight vertical line below the center horizontal hairline, the adjustable sighting marks being adjustable relative to the center horizontal straight hairline; and an adjustment mechanism disposed on the housing and that is user-operable to adjust the adjustable sighting marks relative to the center horizontal straight hairline.

20. The telescopic gun sight of claim 19, wherein the plurality of adjustable sighting marks are movable relative to the central sighting mark.

21. The telescopic gun sight of claim 20, wherein the plurality of movable sighting marks are individually movable.

* * * * *